US008746325B2

(12) United States Patent
Huang

(10) Patent No.: US 8,746,325 B2
(45) Date of Patent: Jun. 10, 2014

(54) NON-BASE BLOCK HEAT SINK

(76) Inventor: Tsung-Hsien Huang, I-Lan Hsien (TW)

( * ) Notice: Subject to any disclaimer, the term of this patent is extended or adjusted under 35 U.S.C. 154(b) by 510 days.

(21) Appl. No.: 13/053,537

(22) Filed: Mar. 22, 2011

(65) Prior Publication Data

US 2012/0241132 A1 Sep. 27, 2012

(51) Int. Cl.
*F28F 7/00* (2006.01)

(52) U.S. Cl.
USPC ..... 165/80.2

(58) Field of Classification Search
CPC ..... H01L 23/4093
USPC ..... 165/80.2, 80.3; 361/700
See application file for complete search history.

(56) References Cited

U.S. PATENT DOCUMENTS

| | | | | |
|---|---|---|---|---|
| 5,829,516 | A * | 11/1998 | Lavochkin | 165/80.4 |
| 6,408,934 | B1 * | 6/2002 | Ishida et al. | 165/80.3 |
| 6,853,555 | B2 * | 2/2005 | Fichera et al. | 361/700 |
| 7,441,592 | B2 * | 10/2008 | Huang | 165/104.33 |
| 8,132,615 | B2 * | 3/2012 | Lin et al. | 165/80.3 |
| 8,191,612 | B2 * | 6/2012 | Huang | 165/80.3 |
| 8,322,403 | B2 * | 12/2012 | Lin et al. | 165/80.2 |
| 2005/0098304 | A1 * | 5/2005 | Lin et al. | 165/104.33 |
| 2005/0195569 | A1 * | 9/2005 | Hsu | 361/697 |
| 2006/0225866 | A1 * | 10/2006 | Chen | 165/80.3 |
| 2007/0107871 | A1 * | 5/2007 | Xia et al. | 165/80.3 |
| 2007/0215327 | A1 * | 9/2007 | Lai et al. | 165/104.33 |
| 2007/0267181 | A1 * | 11/2007 | Lin et al. | 165/104.33 |
| 2009/0178787 | A1 * | 7/2009 | Huang | 165/104.33 |
| 2009/0194255 | A1 * | 8/2009 | Huang | 165/80.3 |
| 2009/0229789 | A1 * | 9/2009 | Lu | 165/80.3 |
| 2009/0229790 | A1 * | 9/2009 | Lu | 165/80.3 |
| 2010/0025014 | A1 * | 2/2010 | Zha | 165/80.3 |
| 2010/0270007 | A1 * | 10/2010 | Lin | 165/80.2 |
| 2011/0290449 | A1 * | 12/2011 | Huang | 165/104.26 |
| 2012/0043057 | A1 * | 2/2012 | Wu | 165/104.26 |
| 2012/0205084 | A1 * | 8/2012 | Huang | 165/181 |
| 2012/0222839 | A1 * | 9/2012 | Huang | 165/104.26 |
| 2012/0222840 | A1 * | 9/2012 | Huang | 165/104.26 |

* cited by examiner

*Primary Examiner* — Brandon M Rosati
(74) *Attorney, Agent, or Firm* — Pai Patent & Trademark Law Firm; Chao-Chang David Pai

(57) ABSTRACT

A non-bottom block heat sink includes a radiation module formed of a rack of radiation fins, each radiation fin having a plurality of locating notches located on one peripheral edge thereof and a supporting rib disposed between each two adjacent locating notches, and a plurality of heat pipes each having heat receiving end press-fitted into the locating notches of the radiation fins and engaged with the supporting ribs and peripherally abutted against one another in flush the associating peripheral edge of each radiation fin and a heat discharging end extended from the heat receiving end and fastenable to the radiation fins or an external radiation fin module.

14 Claims, 11 Drawing Sheets

NON-BASE BLOCK HEAT SINK

BACKGROUND OF THE INVENTION (a) Field of the Invention

The present invention relates to heat sink and more particularly, to a non-base block heat sink, which comprises a stack of radiation fins and a plurality of heat pipes press-fitted into a series of locating notches at one peripheral edge of each of the radiation fins and peripherally abutted against one another in flush with the associating peripheral edge of each of the radiation fins.

(b) Description of the Prior Art

A conventional heat pipe attached heat sink generally comprises a radiation fin module, a plurality of heat pipes and a metal bottom block. The metal bottom block is adapted for direct contact with a heat source for enabling absorbed heat energy to be transferred by the heat pipe to the radiation fin modules for quick dissipating into the outside open air. The heat pipes are bonded to the metal bottom block with a solder paste. Because the metal bottom block and the heat pipes are respectively made of different metal materials, an electroplating procedure is necessary before bonding the heat pipes to the metal bottom block. This installation procedure complicates the fabrication and greatly increases the cost. Further, it is not environmentally friendly to bond the heat pipes and the metal bottom block by means of a soldering technique. Further, because the metal bottom block is a solid block member, it consumes much metal material and greatly increases the material cost and the weight of the heat sink.

Further, the metal bottom block is processed to provide locating grooves for accommodating the heat pipes. These locating grooves are spaced from one another at a distance, i.e., the heat pipes cannot be closely arranged together at the bottom side of the metal bottom block, lowering the performance. The heat pipes at the two opposite lateral sides may be kept away from the heat source at a distance, lowering the heat transfer efficiency. Because the heat pipes are spaced from one another at a distance, they cannot transfer heat energy directly from one another.

SUMMARY OF THE INVENTION

The present invention has been accomplished under the circumstances in view. It is one object of the present invention to provide a non-bottom block heat sink, which has a reduced dimension and weight, saving much material consumption, relatively lowering the cost and facilitating packing for delivery.

To achieve this and other objects of the present invention, a non-bottom block heat sink comprises at least one radiation module and a plurality of heat pipes fastened to the at least one radiation module. Each radiation fin module comprises a plurality of radiation fins arranged in a stack. Each radiation fin comprises a plurality of locating notches located on one peripheral edge thereof and a supporting rib disposed between each two adjacent ones of the locating notches. Each heat pipes comprises opposing heat receiving end and heat discharging end. The heat receiving ends of the heat pipes are press-fitted into the locating notches of the radiation fins and engaged with the supporting ribs and peripherally abutted against one another in flush the associating peripheral edge of each radiation fin.

Further, each radiation fin comprises a plurality of stop rib protruded from an inside wall of each locating notch and respectively disposed at selected locations for engagement with the periphery of the heat receiving ends of the heat pipes.

Each radiation fin further comprises a plurality of through holes cut through two opposing sides thereof and disposed remote from the locating notches thereof. Further, each radiation fin can be made having a plurality of retaining lugs located on an opposite peripheral edge thereof for fastening.

Further, the non-bottom block heat sink can be formed of two radiation fin modules, and the heat receiving ends and heat discharging ends can be respectively fastened to the two radiation fin modules.

Further, the heat receiving end of each heat pipe can be made having a raised platform portion on the middle thereof for direct contact with an external heat source.

Further, the stop ribs of each radiation fin can be shaped like a bar. Alternatively, the stop ribs of each radiation fin can be rounded shaped.

DETAILED DESCRIPTION OF THE PREFERRED EMBODIMENTS

Figure 1:
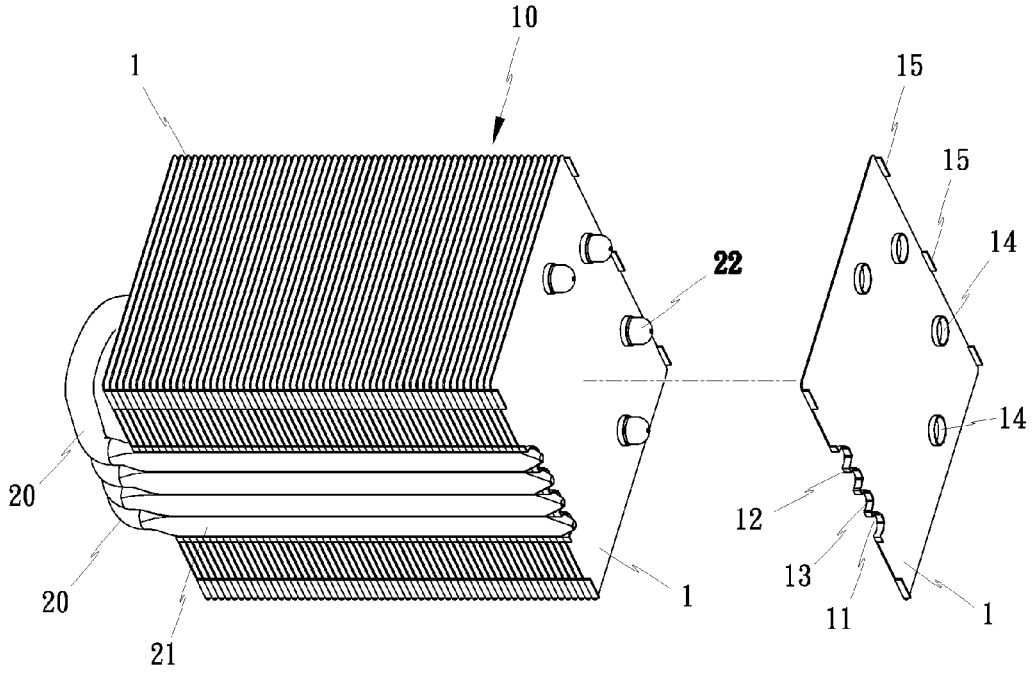
FIG. 1 is a schematic assembly view of a non-bottom block heat sink in accordance with a first embodiment of the present invention.
Figure 2:
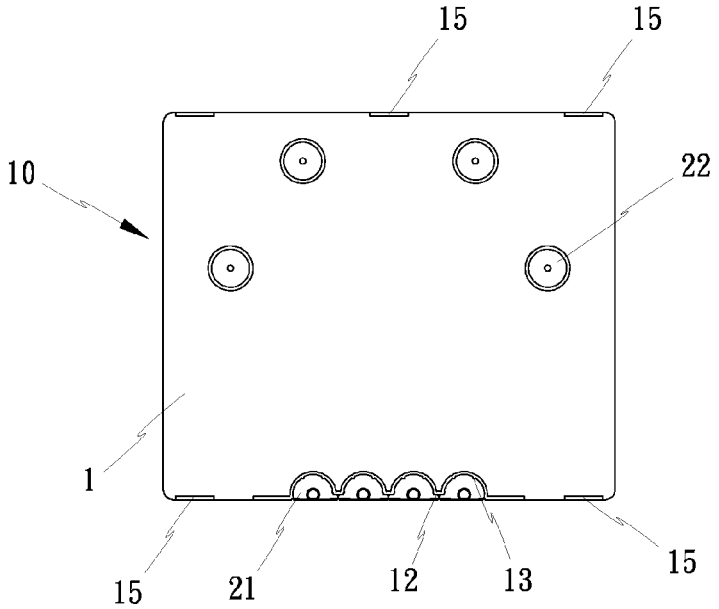
FIG. 2 is a side view of the non-bottom block heat sink in accordance with the first embodiment of the present invention.
Figure 3:
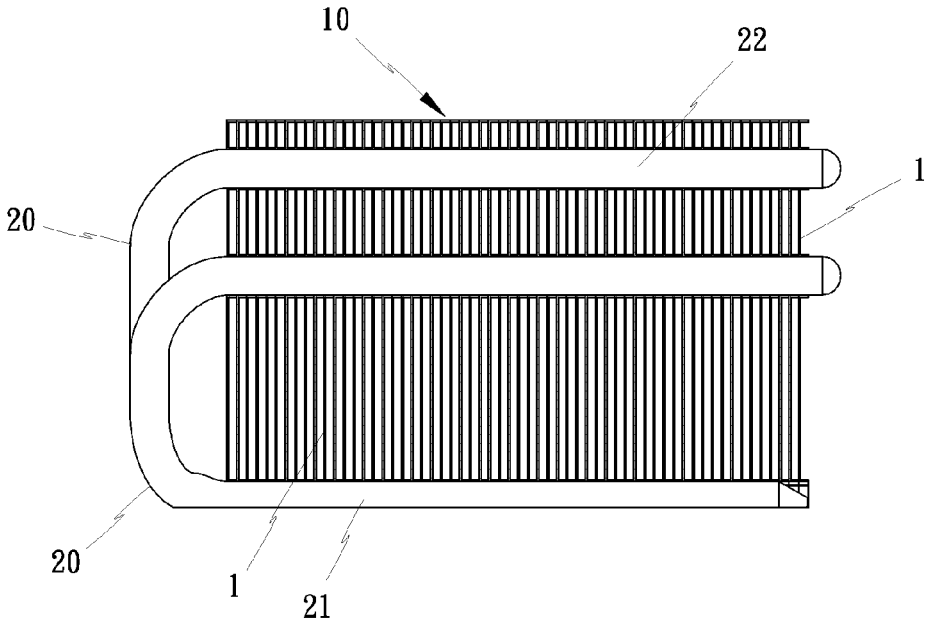
FIG. 3 is a sectional view of the non-bottom block heat sink in accordance with the first embodiment of the present invention.

Referring to FIGS. 1~3, a non-bottom block heat sink in accordance with a first embodiment of the present invention is shown comprising a radiation fin module 10 and a plurality of heat pipes 20.

Figure 4:
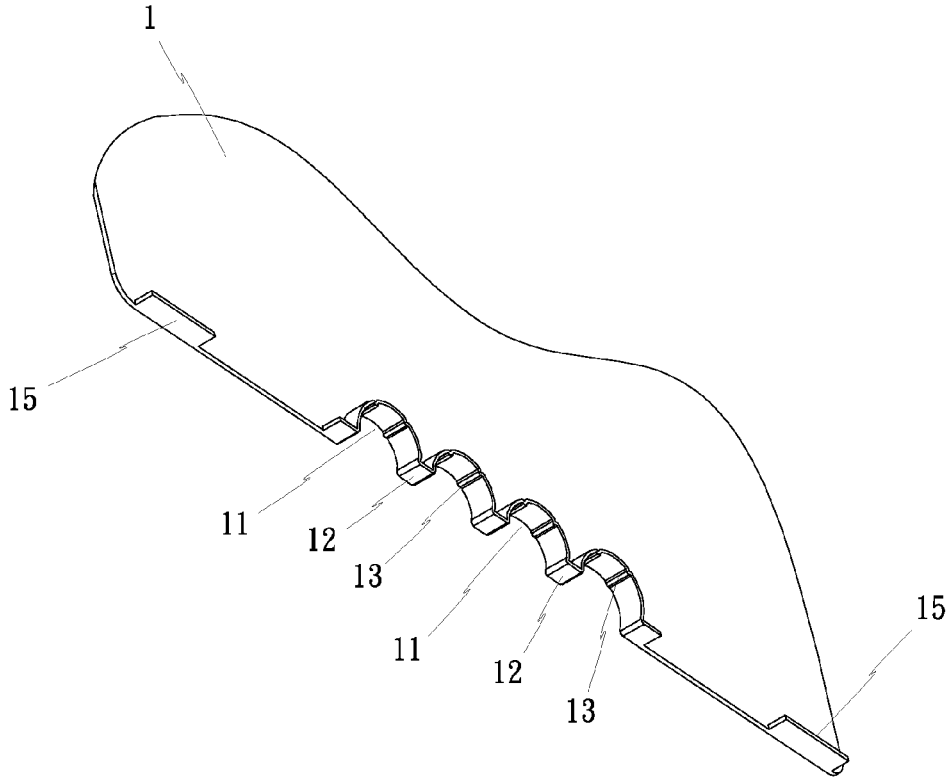
FIG. 4 is an elevational view of a part of one radiation fin for non-bottom block heat sink in accordance with the first embodiment of the present invention.
Figure 5:
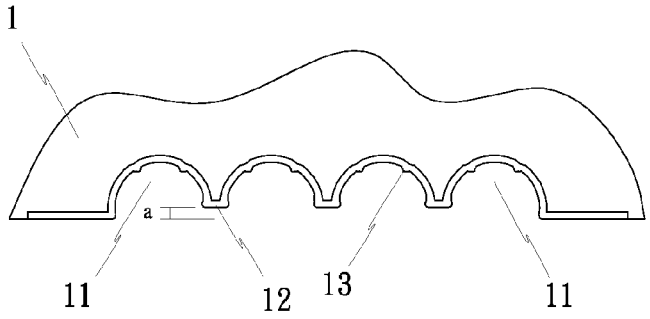
FIG. 5 is a side view of a part of one radiation fin for non-bottom block heat sink in accordance with a first embodiment of the present invention.

The radiation fin module 10 is formed of a stack of radiation fins 1. As shown in FIG. 4, each radiation fin 1 comprises a plurality of locating notches 11 located on one peripheral edge thereof, a supporting rib 12 disposed between each two adjacent locating notches 11 and kept away from the elevation of the associating peripheral edge at a predetermined distance (see the elevation difference referenced by a in FIG. 5) and at least one stop rib 13 located on the inside wall of each locating notch 11 (see FIG. 4).

The heat pipes 20 are configured subject to a predetermined shape, each having opposing heat receiving end 21 and heat discharging end 22.

Figure 6:
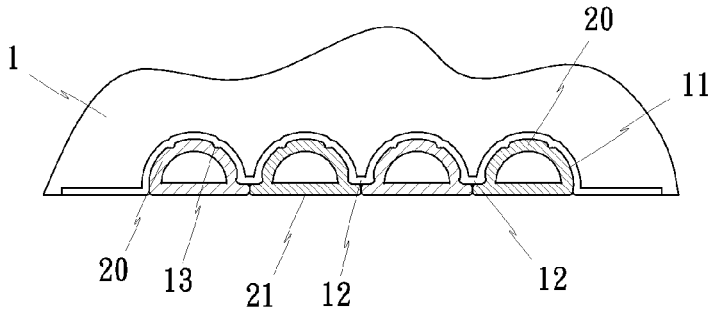
FIG. 6 corresponds to FIG. 5, illustrating heat pipes press-fitted into the locating notches of the radiation fin and peripherally partially abutted against one another in flush with the associating peripheral edge of the radiation fin.

When assembling the radiation fin module 10 and the plurality of heat pipes 20 together, press-fit the heat receiving ends 21 of the heat pipes 20 into the locating notches 11 of the radiation fins 1 and then flatten the heat receiving ends 21 of the heat pipes 20 to keep the flattened outside walls of the heat receiving ends 21 of the heat pipes 20 be peripherally partially abutted against one another in flush with the associating peripheral edge of each of the radiation fins 1 (see FIG. 6) for positive contact with a heat source for quick dissipation of heat. As the invention enables heat pipes to be peripherally partially abutted against one another, a relatively greater number of heat pipes can be installed. Further, the invention eliminates the use of a bottom block to hold the radiation fins, the dimension and weight of the heat sink are greatly reduced, saving much material consumption, relatively lowering the cost and facilitating packing for delivery.

Subject to the arrangement of the stop ribs 13 in the locating notches 11 and the supporting ribs 12 in between each two adjacent locating notches 11, flattening the heat pipes 20 causes deformation of the stop ribs 13 and the supporting ribs 12 and tight engagement between the deformed stop ribs 13 and supporting ribs 12 and the heat receiving ends 21 of the heat pipes 20, enhancing tight contact between the heat pipes 20 and the radiation rings 1.

Each radiation fin 1 of the radiation fin module 10 further comprises a plurality of through holes 14 cut through two opposing sides thereof remote from the locating notches 11 for receiving the heat discharging ends 22 of the heat pipes 20 respectively, assuring tight connection between the radiation fin module 10 and the heat pipes 20.

As illustrated in FIG. 4, the locating notches 11 of each radiation fin 1 are formed by stamping subject to a predetermined configuration. Each radiation fin 1 further comprises a plurality of retaining lugs 15 located on an opposite peripheral edge thereof opposite to the locating notches 11. By means of the retaining lugs 15 of one radiation fin 1 to secure another radiation fin 1, the multiple radiation fins 1 can be quickly and firmly stacked up, forming the radiation fin module 10.

Figure 8:
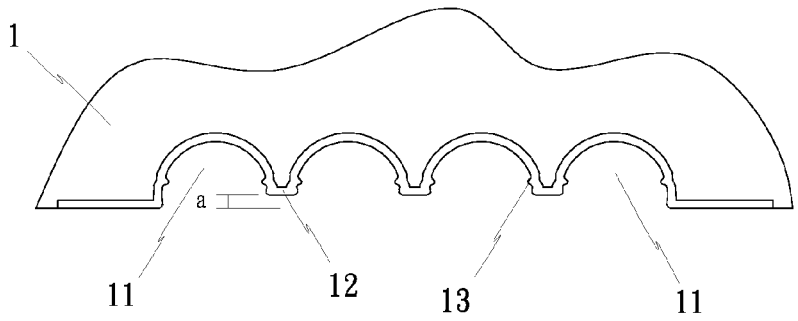
FIG. 8 corresponds to FIG. 6 but illustrating another arrangement of the stop ribs in the locating notches.
Figure 9:
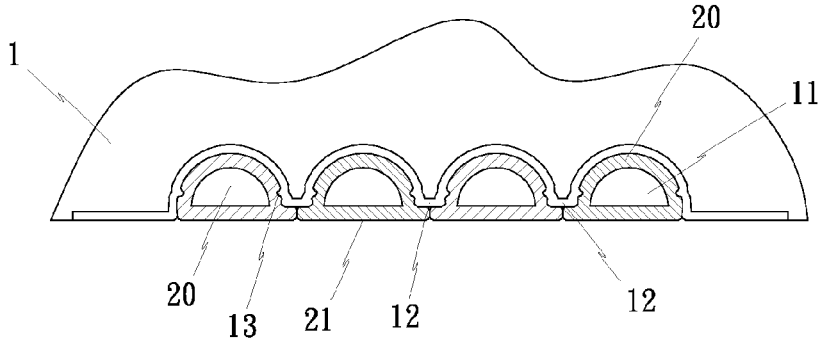
FIG. 9 corresponds to FIG. 8, illustrating heat receiving ends of heat pipes respectively press-fitted into the locating notches of the radiation fin.

In an alternate form of the present invention as shown in FIG. 8 and FIG. 9, stop ribs 13 are respective located in the locating notches 11 adjacent to the associating peripheral edge of the respective radiation fin 1. When flattening the heat receiving ends 21 of the heat pipes 20 after setting of the heat receiving ends 21 in the respective locating notches 11, the stop ribs 13 are respectively forced inwards into engagement with the periphery of the heat receiving ends 21 of the respective heat pipes 20, enhancing connection tightness between the radiation fin module 10 and the heat pipes 20.

Figure 10:
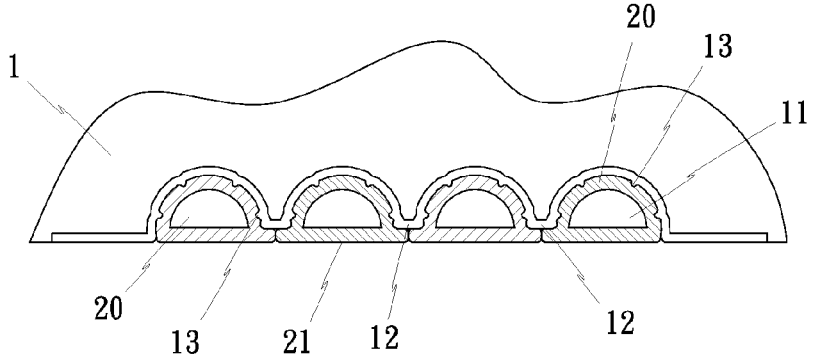
FIG. 10 corresponds to FIG. 10, illustrating an alternate arrangement of stop ribs in the locating notches of the radiation fin and engagement between the stop ribs of the heat receiving ends of heat pipes.

FIG. 10 illustrates another alternate form of the present invention. According to this embodiment, multiple stop ribs 13 are respectively disposed in each locating notch 11 at the deep inner side and each of the opposite lateral outer sides, enhancing connection tightness between the radiation fin module 10 and the heat pipes 20.

Figure 7:
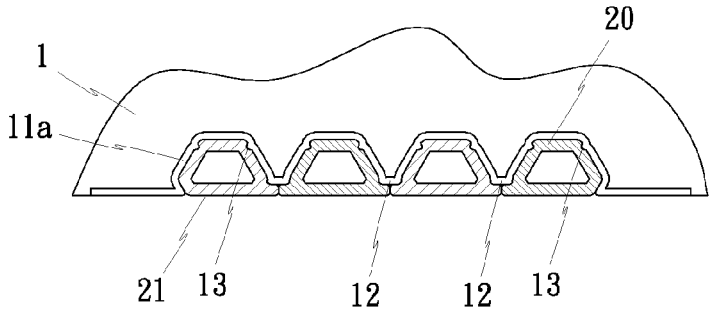
FIG. 7 is similar to FIG. 6 but illustrating another configuration of the locating notches.

The locating notches 11 of the radiation fin 1 may be variously shaped. For example, the locating notches 11 can be made having a semicircular shape shown in FIG. 5, or multilateral shape shown in FIG. 7. Of course, subject to the variation of shape of the locating notches 11 or 11*a*, the configuration of the heat receiving ends 21 of the respective heat pipes 20 must be relatively changed.

Further, the heat discharging ends 22 of the heat pipes 20 can be positioned in the radiation fin module 10 (see FIGS. 1~3). Alternatively, the heat discharging ends 22 of the heat pipes 20 can be extended from one radiation fin module 10 and positioned in another radiation fin module or other radiation fin modules (see FIGS. 11~20). By means of assembling one set of heat pipes with multiple radiation fin modules, heat dissipation performance is enhanced.

Figure 11:
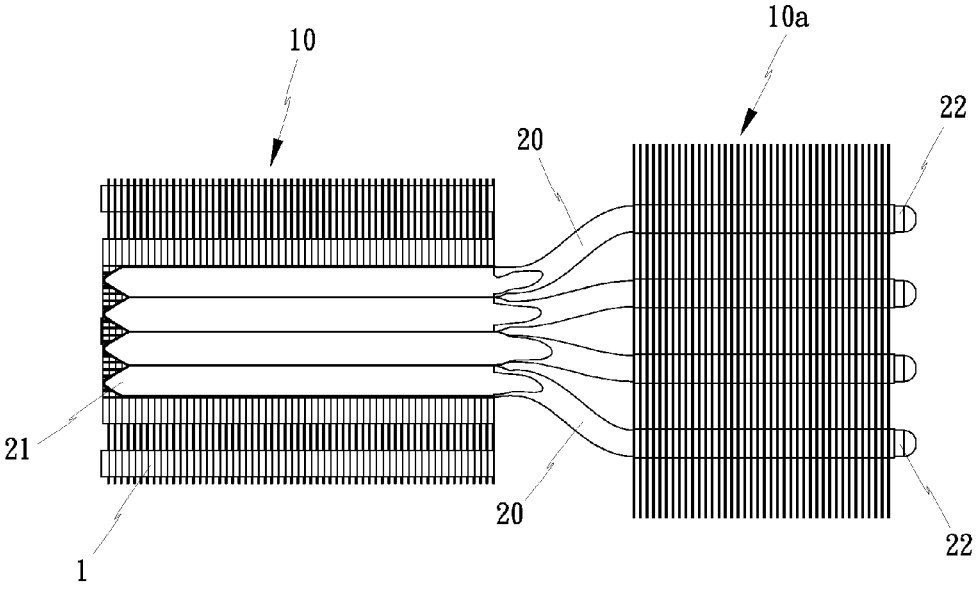
FIG. 11 is a bottom view of a non-bottom block heat sink in accordance with a second embodiment of the present invention.
Figure 12:
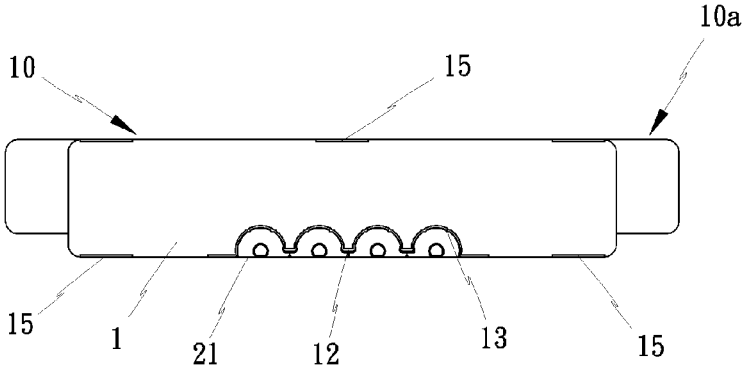
FIG. 12 is a side view of FIG. 11.

According to the embodiment shown in FIG. 11 and FIG. 12, the non-bottom block heat sink comprises two radiation fin modules 10; 10*a* and a plurality of heat pipes 20, wherein the heat discharging ends 22 of the heat pipes 20 are respectively extended out of the first radiation fin module 10 and positioned in the second radiation fin module 10*a*

Figure 13:
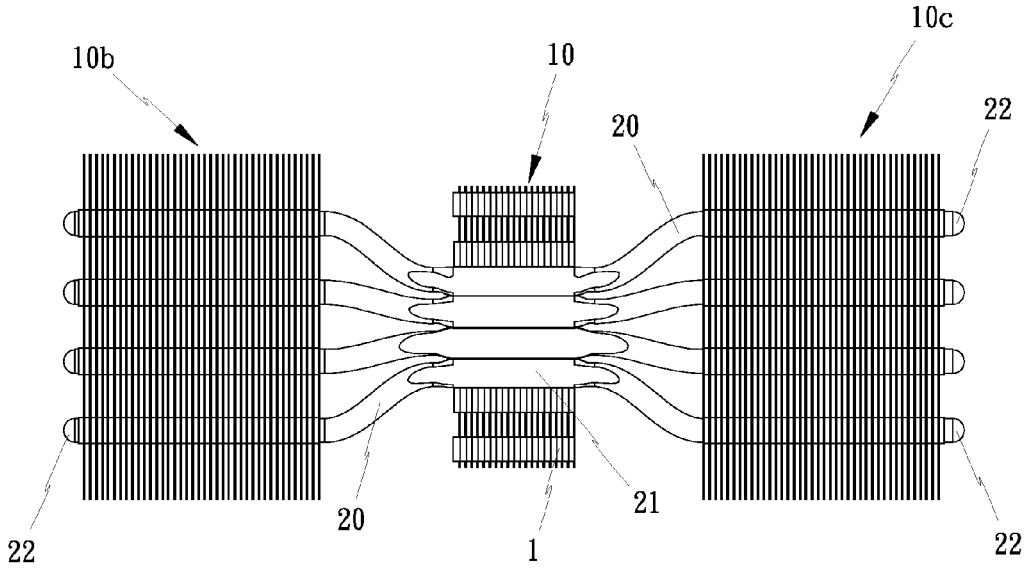
FIG. 13 is a bottom view of a non-bottom block heat sink in accordance with a third embodiment of the present invention.
Figure 14:
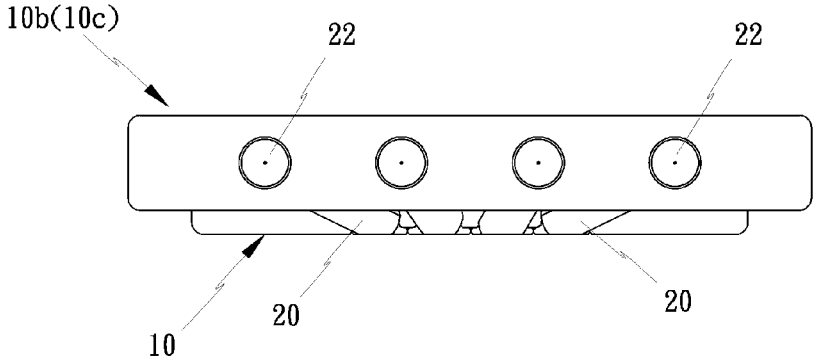
FIG. 14 is a side view of FIG. 13.

According to the embodiment shown in FIG. 13 and FIG. 14, the non-bottom block heat sink comprises three radiation fin modules 10; 10*b*; 10*c* and a plurality of heat pipes 20, wherein the heat discharging ends 22 of the heat pipes 20 are respectively extended from the first radiation fin modules 10 and respectively positioned in the second radiation fin module 10*b* and the third radiation fin modules 10*c*.

Figure 15:
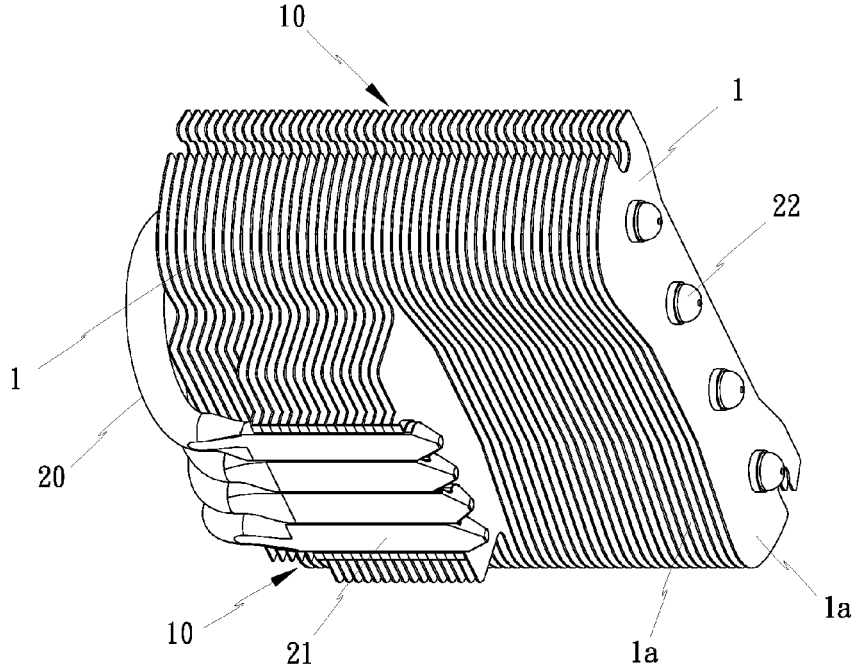
FIG. 15 is an oblique bottom view of a non-bottom block heat sink in accordance with a fourth embodiment of the present invention.
Figure 16:
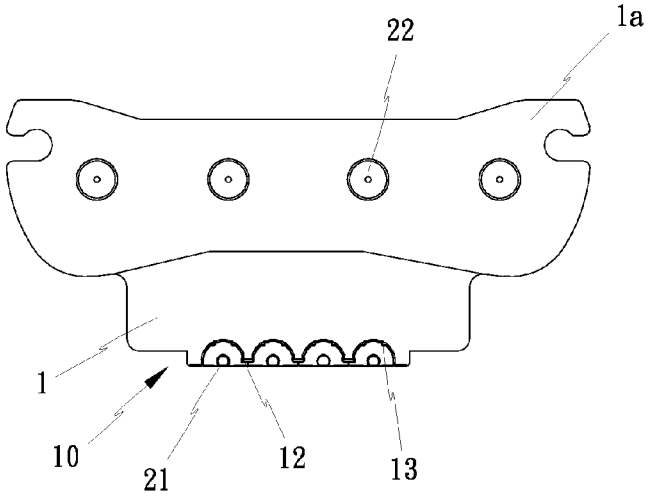
FIG. 16 is a side view of FIG. 15.

According to the embodiment shown in FIG. 15 and FIG. 16, the heat receiving ends 21 of the heat pipes 20 are positioned in the radiation fins 1*a* of the radiation fin module 10 and kept apart from one another at a predetermined distance, and the heat discharging ends 22 of the heat pipes 20 are respectively press-fitted into one peripheral edge of each of the radiation fin 1*a* and peripherally partially abutted against one another.

Figure 17:
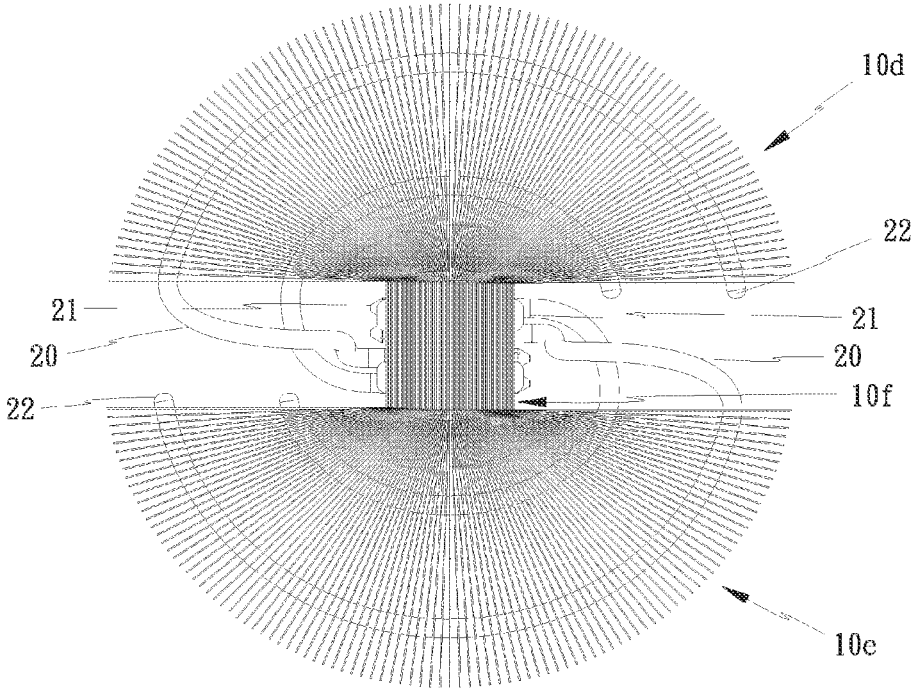
FIG. 17 is a bottom view of a non-bottom block heat sink in accordance with a fifth embodiment of the present invention.
Figure 18:
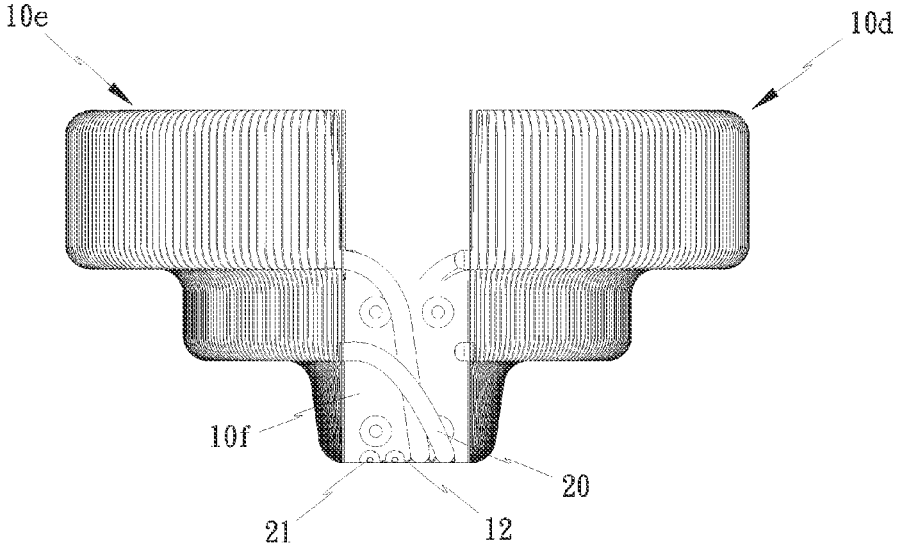
FIG. 18 is a side view of FIG. 17.

According to the embodiment shown in FIG. 17 and FIG. 18, the non-bottom block heat sink comprises two sector-like radiation fin modules 10*d*; 10*e* arranged together and a plurality of heat pipes 20 arranged in two reversed set. The heat discharging ends 22 of the heat pipes 20 are smoothly arched and fastened to the sector-like radiation fin modules 10*d*; 10*e*. The stepped lower parts of the two sector-like radiation fin modules 10*d*; 10*e* constitute a center radiation fin module 10*f*.

Figure 19:
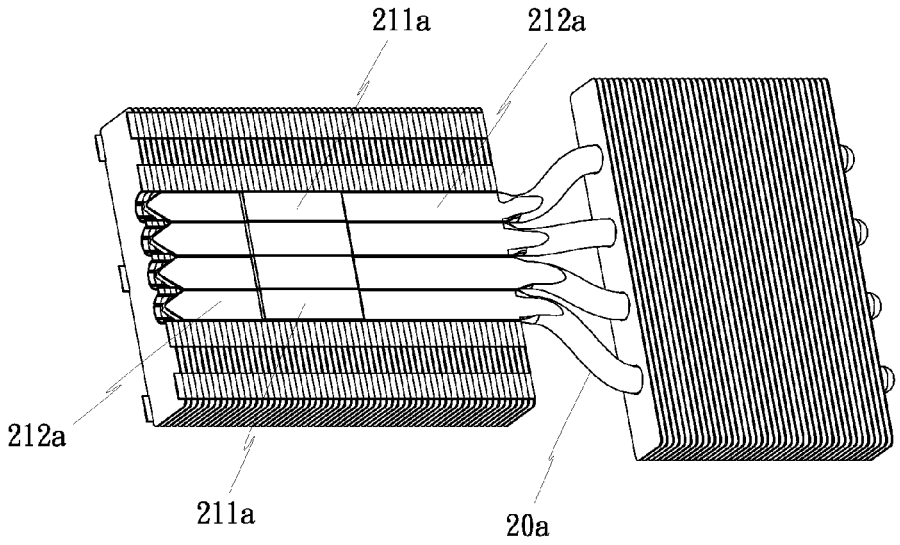
FIG. 19 is an oblique bottom elevational view of a non-bottom block heat sink in accordance with a sixth embodiment of the present invention.
Figure 20:
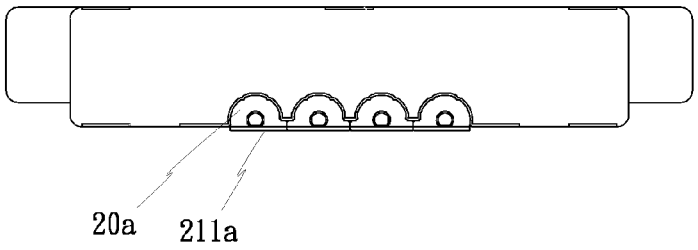
FIG. 20 is a side view of FIG. 19.

According to the embodiment shown in FIG. 19 and FIG. 20, the heat receiving end of each heat pipe 20*a* comprises a raised platform portion 211*a* on the middle and two recessed face portions 212*a* at two opposite lateral sides of the raised platform portion 211*a*. During installation, the raised platform portion 211*a* of each respective heat pipe 20*a* is kept in close contact with the heat source, and the recessed face portions 212*a* is spaced from the heat source at a distance, avoiding interference with particular electronic components.

Further, the stop ribs 13 can be variously shaped. For example, the stop ribs 13 can be shaped like a straight bar.

Figure 21:
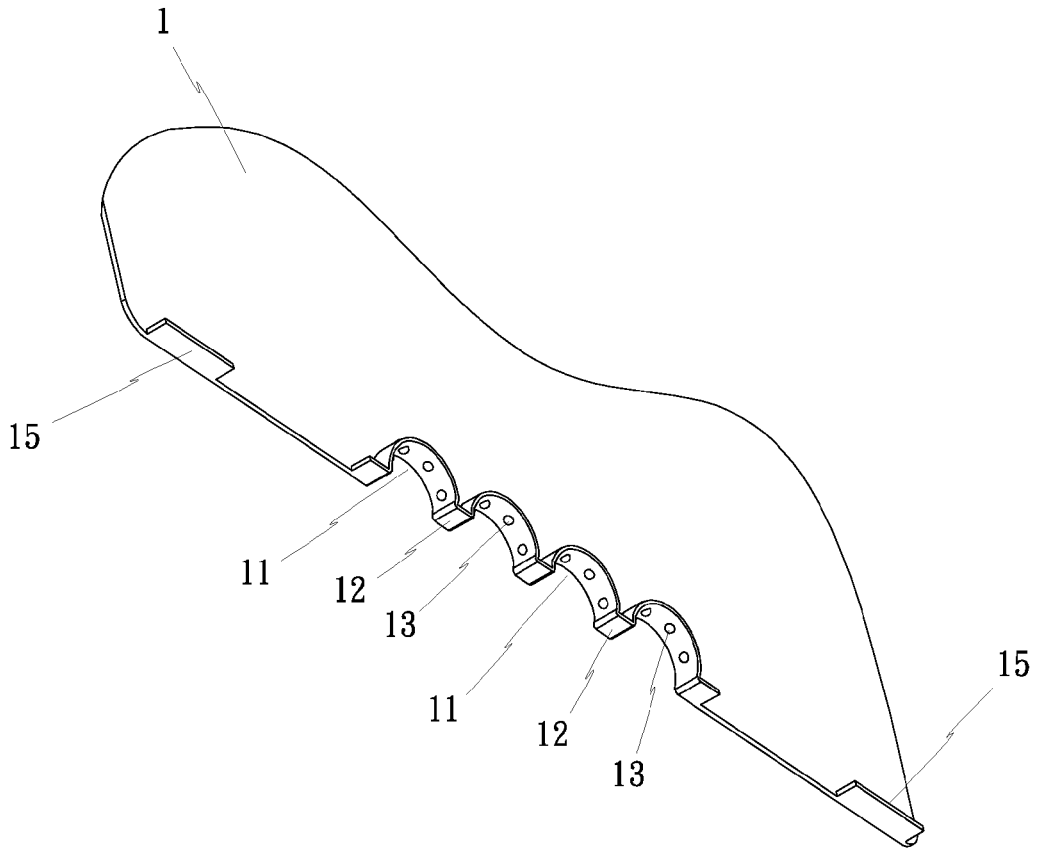
FIG. 21 illustrates an alternate form of the stop ribs in the locating notches of one radiation fin for radiation fin module for non-bottom block heat sink.

Alternatively, the stop ribs 13 can be rounded shaped (see FIG. 21) for engagement with the heat receiving ends 21 of the heat pipes 20.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A non-bottom block heat sink, comprising at least one radiation module and a plurality of heat pipes fastened to said at least one radiation module, wherein:

each said radiation fin module comprises a plurality of radiation fins arranged in a stack, each said radiation fin comprising a plurality of locating notches located on a bottom peripheral edge thereof and a supporting rib disposed between each two adjacent ones of said locating notches, wherein the supporting rib is at a predetermined distance above the elevation of the bottom peripheral edge;

each said heat pipes comprises opposing heat receiving end and heat discharging end, the heat receiving ends of said heat pipes being press-fitted into said locating notches of said radiation fins and engaged with said supporting ribs, and the heat receiving ends of said heat pipes each having a flattened bottom side with a portion extending under the adjacent supporting ribs and peripherally abutted against one another such that the flattened bottom sides of said heat pipes are flush with the bottom peripheral edge of each said radiation fin and form a substantially flat and continuous surface; and each said radiation fin further comprises at least one stop rib protruding from an inside wall of each said locating notch and denting the outer wall, but not an inner wall of the respective heat pipe.

2. The non-bottom block heat sink as claimed in claim 1, wherein at least one said stop rib of each said locating notch is adjacent to the bottom peripheral edge of the respective radiation fin.

3. The non-bottom block heat sink as claimed in claim 2, wherein at least another said stop rib of each said locating notch is disposed at an inner side far from the bottom peripheral edge of the respective radiation fin.

4. The non-bottom block heat sink as claimed in claim 1, wherein each said radiation fin further comprises a plurality of through holes cut through two opposing sides thereof and disposed remote from the locating notches thereof.

5. The non-bottom block heat sink as claimed in claim 1, wherein each said radiation fin is formed with the respective locating notches and stop ribs in integrity by means of stamping a single piece sheet material into shape.

6. The non-bottom block heat sink as claimed in claim 1, wherein each said radiation fin further comprises a plurality of retaining lugs located on an peripheral edge thereof opposite to the bottom peripheral edge for fastening.

7. The non-bottom block heat sink as claimed in claim 1, wherein the locating notches of each said radiation fin have a semicircular shape.

8. The non-bottom block heat sink as claimed in claim 1, wherein the locating notches of each said radiation fin have a multilateral shape.

9. The non-bottom block heat sink as claimed in claim 1, wherein the heat discharging ends of said heat pipes are respectively inserted through said radiation fin module.

10. The non-bottom block heat sink as claimed in claim 1, wherein said at least one radiation fin module includes a first radiation fin module and a second radiation fin module; each said heat pipe has the heat receiving end thereof fastened to said first radiation fin module and the heat discharging end thereof fastened to said second radiation fin module.

11. The non-bottom block heat sink as claimed in claim 1, wherein said at least one radiation fin module includes a first sector-like radiation fin module and a second sector-like radiation fin module, said first sector-like radiation fin module and said second sector-like radiation fin module being abutted together to form a circular radiation fin module assembly; said heat pipes are reversely arranged in two sets, each having the heat receiving end thereof fastened to one of said first sector-like radiation fin module and said second sector-like radiation fin module and the heat discharging end thereof fastened to the other of said first sector-like radiation fin module and said second sector-like radiation fin module.

12. The non-bottom block heat sink as claimed in claim 1, wherein the heat receiving end of each said heat pipe comprises a raised platform portion on a middle part thereof for direct contact with an external heat source.

13. The non-bottom block heat sink as claimed in claim 1, wherein said stop ribs of each said radiation fin is shaped like a bar.

14. The non-bottom block heat sink as claimed in claim 1, wherein said stop ribs of each said radiation fin is rounded shaped.

* * * * *